United States Patent [19]

von Bennigsen-Mackiewicz et al.

[11] Patent Number: 4,790,708

[45] Date of Patent: Dec. 13, 1988

[54] DEVICE FOR EMPTYING CONTAINERS

[76] Inventors: Andreas von Bennigsen-Mackiewicz; Christoph von Bennigsen-Mackiewicz, both of Mühlenstr. 17, D-3211 Banteln, Fed. Rep. of Germany

[21] Appl. No.: 886,372

[22] Filed: Jul. 17, 1986

[30] Foreign Application Priority Data

Oct. 8, 1985 [DE] Fed. Rep. of Germany ... 8528561[U]

[51] Int. Cl.[4] ..... B65G 65/23

[52] U.S. Cl. ..... 414/403; 414/422; 414/291; 414/785; 222/181; 406/136; 285/236; 285/322; 294/902; 294/88; 269/285

[58] Field of Search ..... 414/403, 404, 414, 411, 414/412, 422, 291; 901/39; 222/105, 181, 180, 527; 294/88, 902, 106; 285/322, 420, 243, 18, 236, 242; 269/86, 89, 237, 275, 268, 265, 285, 286; 406/136, 137, 138

[56] References Cited

U.S. PATENT DOCUMENTS

| | | | |
|---|---|---|---|
| 2,985,455 | 5/1961 | Powell | 269/285 X |
| 3,101,812 | 8/1963 | Mercer, Sr. | 285/236 X |
| 3,322,455 | 5/1967 | Gressbach | 294/902 X |
| 3,672,717 | 6/1972 | Sayre | 294/88 X |
| 3,744,822 | 7/1973 | Arnold | 285/322 X |
| 3,961,655 | 6/1976 | Nattrass et al. | 222/181 X |
| 4,167,235 | 9/1979 | Green | 222/181 X |
| 4,182,591 | 1/1980 | Stanelle | 414/291 |
| 4,212,577 | 7/1980 | Swanson | 414/23 |
| 4,502,819 | 3/1985 | Fujii et al. | 405/136 X |

FOREIGN PATENT DOCUMENTS

| | | | |
|---|---|---|---|
| 2717563 | 3/1979 | Fed. Rep. of Germany | 294/902 |
| 611775 | 5/1978 | U.S.S.R. | 901/39 |

*Primary Examiner*—Frank E. Werner
*Attorney, Agent, or Firm*—Gilbert L. Wells

[57] ABSTRACT

A device for emptying flexible or rigid containers having flexible discharge stubs for in bulk goods where the discharge stubs are sealable by being tied shut and always issue into the emptying device from where the in bulk goods are conveyed out by partial vacuum or free fall. The emptying device (6) consists of an upright cylindrical housing (7) having an outside diameter less than the inside diameter of the discharge stub (4). This housing, when connected, is spanned by the discharge stub (4). At least two jaws (10) which when closed are spaced away from the housing wall are provided to which are mounted at least one elastic belt, a cord (11) or the like which in the closed state of the jaws (10) rests while prestressed over the entire periphery of the housing (7) against the discharge stub (4) spanning the housing (7).

25 Claims, 3 Drawing Sheets

DEVICE FOR EMPTYING CONTAINERS

BACKGROUND OF THE INVENTION

The invention concerns a device for emptying flexible or rigid containers with flexible discharge stubs for in-bulk goods, the discharge stubs being sealable by being tied shut and always issuing into the emptying device from which the in-bulk good is removed by partial vacuum or free fall.

The known equipment incurs the drawback that after the tied closure of the container has been released, the in-bulk goods discharge abruptly and with formation of dust, so that there is a danger when the discharge part is not tightly connected to the container, of some of the dust issuing into the ambience. This is particular drawback where the in-bulk material and its dust are healthdamaging substances.

It is therefore the object of the invention to so design an emptying device of the initially mentioned kind that the issuance of dust is reliably prevented in the junction region and that furthermore the junction itself can be provided in simple and problem-free manner and be operated by unskilled labor.

SUMMARY OF THE INVENTION

This problem is solved by the invention in that the emptying consists of an upright cylindrical housing with an outside diameter less than the inside diameter of the discharge stub, this housing being spanned by the discharge stub when connected, with at least two jaws, which when closed are spaced from the housing wall, being provided to which is mounted at least one elastic belt, cord or the like which for the closed condition of the jaws rests prestressed over the entire periphery of the housing against the discharge stub spanning this housing.

By means of this design, the flexible discharge stub of the container can be pulled over the housing and thereupon, after actuation of the jaws, the free end of this discharge stub can be clamped by the elastic belt or the like against the outer wall of the housing. Thereupon the tied-together seal of the container discharge stub is opened, whereby the in-bulk goods can enter the housing from which it can be conveyed away.

Because the discharge stubs of the container have a larger diameter than the housing, they are easily guided, possibly merely by gravity, over the housing. As a result however, when the jaws are actuated, there also will be pleat formation in the area of the elastic belt or the like. Such inaccuracies however are always compensated by the uniform application of the elastic belt.

In an especially advantageous manner, the elastic belt is a rubber cord of approximately circular cross-section whereby the danger of uneven application by twisting or the like is avoided.

Appropriately the rubber core is fastened by flexible straps to the jaws so that these jaws can be compressed and will not hamper the application of the rubber cord or elastic belt.

As a rule, one flexible fastener per jaw suffices, being mounted approximately at the jaw center.

Depending on the design of the jaws and on their support, it may be appropriate to mount one further flexible fastener for each in the region of the two mutually adjoining jaw supports.

Furthermore the number and the arrangement of the fasteners depends on the maximum opening width of the jaws.

It has been found however that even at relatively slightly swung-out jaws and for curved jaws, three fastening points are fully adequate for the rubber cord at each jaw, namely one at the free jaw end, another at the center and a third in the area of its support, in order to keep the rubber cord spaced away from the housing.

It is possible as well to replace a single elastic belt, a cord or the like with several belts or cords one above the other in order to increase the area of application.

The jaws are pivotably supported in a housing, the supports being spaced away from the outer periphery of the housing by a distance larger than that initial diameter of the rubber cord or belt so that the container discharge stub can pass between the rubber cord and the outer periphery of the housing.

The jaws are appropriately designed in such a manner that when open, the rubber cord or the elastic belt is held at a distance from the housing outer periphery. To that end, the jaws are suitably curved into arcs of circle.

When designed as above, the jaws do not clamp, rather they merely serve to guide and support the rubber cord or the elastic belt at the housing outside. When the jaws are used as clamping means, the pleats and other inaccuracies in the container discharge stub must be compensated by a thicker layer of foam or sponge rubber or the like at the jaw insides so that they will tightly rest against the outer periphery of the housing.

Appropriately the jaws are linked to an actuation device, their support possibly being at the end of a piston rod of a pneumatic or hydraulic unit. The cylinders of the pneumatic or hydraulic units appropriately are pivotably supported on a fixed crossbeam of the housing.

Advantageously a hollow and upwardly telescoping cylinder may be mounted in the housing. The hollow cylinder may be moved against the pressure of the in-bulk material in the container into the discharge stub at least until its upper edge is flush with the container bottom.

As a result aggregations and bridge formations in the container that illustratively are caused by heaping during substantial shipping times are broken up by the hollow cylinder whereby the discharge procedure can be easily initiated.

This is achieved in advantageous manner especially when the hollow cylinder is equipped with venting means in the form of venting pipes entering the goods to be discharged.

In particular two mutually diametrically opposite venting pipes may be provided in the hollow cylinder. However more than two venting pipes may be mounted equidistantly on the end surface of the hollow cylinder. In a preferred embodiment, four such venting pipes are used. The venting pipes may be loaded impulsively in known manner with compressed air.

To prevent that material to be moved out discharge through the venting pipes, these may appropriately be equipped with clack valves which when not loaded are closed by compressed air.

The hollow cylinder may be fitted with a grid or sieve or the like in the area of the free ends of the venting pipes which face the container, that is, in the region of the container's upper end, in order to retain clumps or coarse ingredients of impurities.

BRIEF DESCRIPTION OF THE DRAWINGS

The invention is discussed in closer detail below in relation to illustrative embodiments shown in the drawing.

DESCRIPTION OF THE PREFERRED EMBODIMENTS

Figure 1:
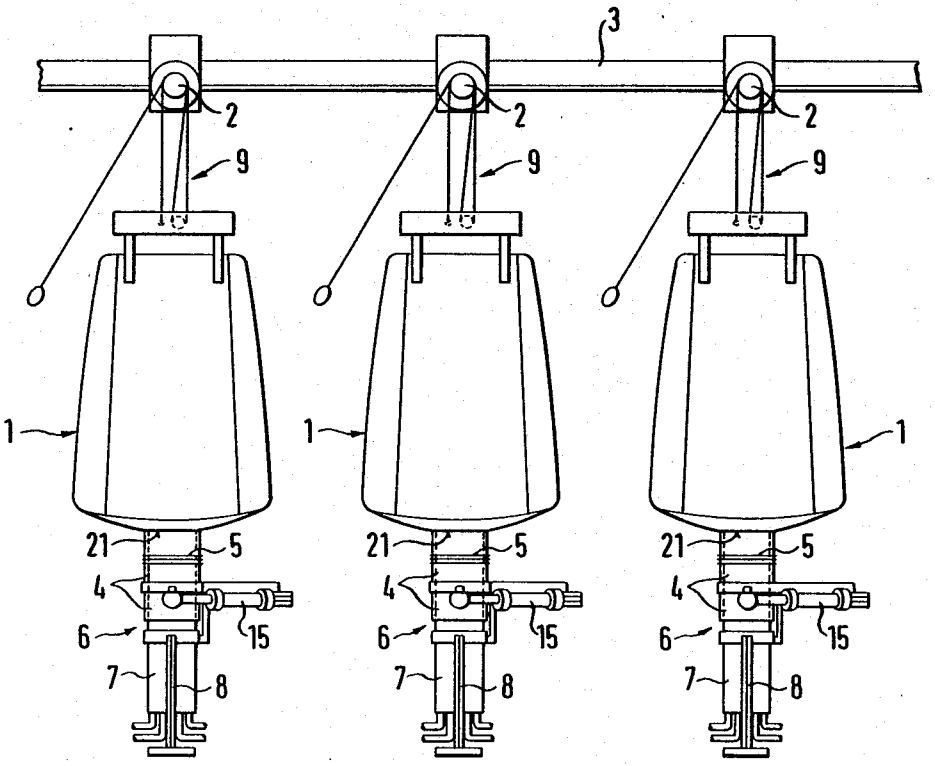
FIG. 1 is a schematic of several flexible containers to which the invention applies.

As shown in FIG. 1, several flexible containers 1 to be emptied are suspended from trolleys 2 and displaceable along a rail 3. Each container 1 is equipped with a flexible discharge stub 4 which can be sealed by schematically indicated tying means 5. The emptying device 6 of the invention is mounted below the discharge stubs 4 and includes an upright cylindrical housing 7 of which the outside diameter is less than the inside diameter of the discharge stub 4, whereby the cylindrical housing 7 can enter the discharge stub provided the container be above the emptying device 6. The cylindrical housing 7 is provided with posts 8 by means of which it rests on the ground and which may also be fixed into the ground.

When the discharge stub 4 has been moved over the cylindrical housing 7, the discharge stub consequently may be pulled or be turned inside out over the housing. Where as for instance shown in FIG. 1 thre is a height adjustment means 9 for the container 1, this container 1 also may be guided at such a distance from the emptying device 6 and above same that the end of the discharge stub 4 (see FIG. 3) will slide over the cylindrical housing 7 due to gravity when the container 1 is being lowered.

Figure 2:
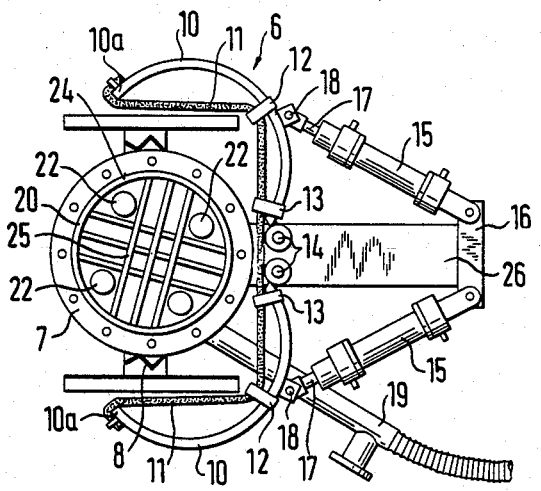
FIG. 2 is a topview of an embodiment of the emptying device of the invention.

FIG. 2 shows the emptying device 6 of FIG. 1 as seen from above. As shown by FIG. 2, two jaws 10 are provided, which enclose the outsides of the housing 7 and which when closed (FIG. 4) are spaced away from the outside wall of the housing 7 and act as support for a rubber cord 11 that in this particular embodiment is fastened in three places to the jaws 10. The fastening sites are the free end 10*a* of the jaw 10 and also two flexible holders 12 and 13 of which one is in the central area of the jaw and the other in the vicinity of pivot bearing 14. The holders 12 and 13 consist of flexible loops passing on one hadn around the jaw 10 and on the other around the rubber cord 11. Because the holders 12 and 13 are flexible, they permit being compressed when placing the rubber cord 11 against the outside of the housing 7.

By means of the bearings 14, the jaws 10 are pivotably supported on the housing, the bearing axes as shown being a greater distance from the periphery of the housing 7 than the initial diameter of the rubber cord 11 so that the discharge 4 of the container 1 can pass through the rubber cord 11 and the outer periphery of the housing 7.

As shown, when the jaws are open, the rubber cord 11 is kept a distance from the outer periphery of the housing 7. To that end, the jaws 10 are made circular whereby, upon placing the jaws against the housing 7 (FIG. 4), the rubber cord 11 will from the beginning be lying as uniformly as possibly against the outer periphery of the housing 7.

The jaws 10 each are actuated by a pneumatic or hydraulic unit 15 which is pivotably supported by its cylinder side on a fixed crossbeam 16. The jaws 10 are linked at 18 to the end of the piston rod 17 of the pneumatic or hydraulic unit 15; this link and bearing site may, as indicated, be approximately at the center of the jaw.

A suction conduit is denoted by 19 in FIG. 2.

A hollow cylinder 20 is mounted within the housing 7 and can be telescoped upward. The hollow cylinder 20 thereby may be introduced against the pressure from the in-bulk goods in the discharge stubs 4 of the container 1 (FIG. 5) at least until its upper edge is flush with the container bottom 21 (FIG. 1).

In the embodiment shown, the hollow cylinder 20 is equipped with four venting pipes 22 mounted equidistantly in the circumferential direction in the hollow cylinder 20. These venting pipes 22 can be loaded in pulses with compressed air to enhance the emptying procedure. To prevent that material to be conveyed out shall exit through the venting pipes 22, these pipes are equipped with clack valves 23 (FIG. 3) which when not loaded are closed by means of the compressed air.

The hollow cylinder 20 is equipped at its upper end 24 (FIG. 3) with a grille 25, a sieve or the like, in order that clumps or lumps ingredients or impurities be retained.

Figure 3:
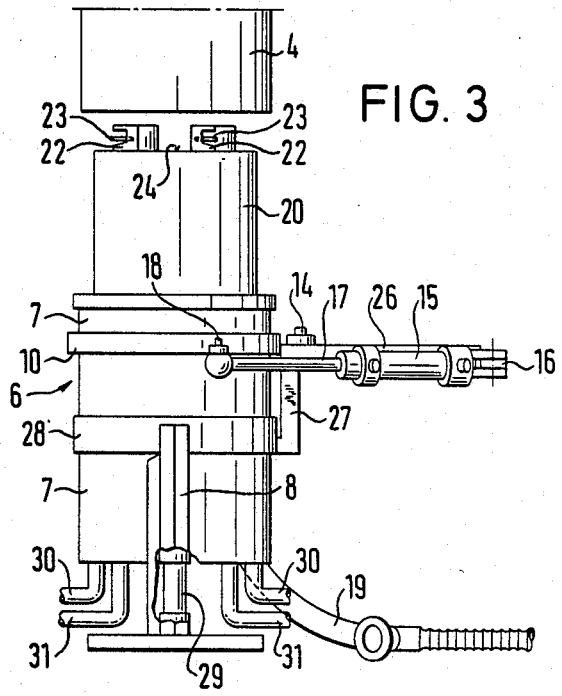
FIG. 3 is a sideview of the device of FIG. 2.

FIG. 3 is a sideview of the device of FIG. 2 and in particular shows the telescoping motion of the hollow cylinder 20 in the housing 7. As is further shown by FIG. 3, the crossbeam 16 is connected to a support 26 fixed by means of a rest 27 to a support rim 28 which in turn is connected to the posts 8.

FIG. 3 further shows a pneumatic or hydraulic unit 29 loading the telescoping hollow cylinder 20 and implementing its up and down motion.

Pipes 30 to feed the compressed air and pipes 31 to evacuate the in-bulk material are provided at the lower part of the housing 7.

Figure 4:
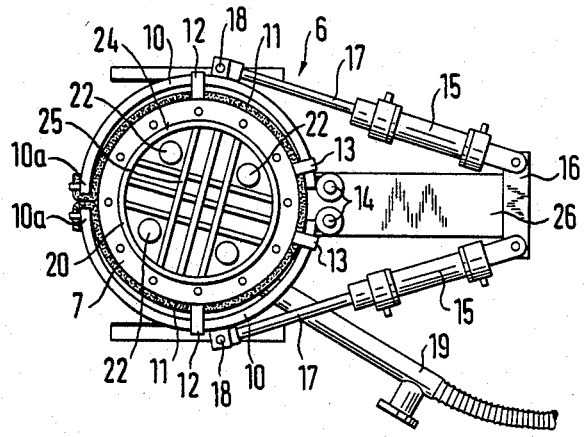
FIG. 4 shows the device of FIG. 2 with closed jaws.

FIG. 4 is the device of FIG. 2 when the jaws 10 are closed, FIG. 4 indicating that in this condition the rubber cord 11 rests uniformly against the housing 7 along its outer periphery. The flexible holders 12 and 13 can be compressed in this condition.

Figure 5:
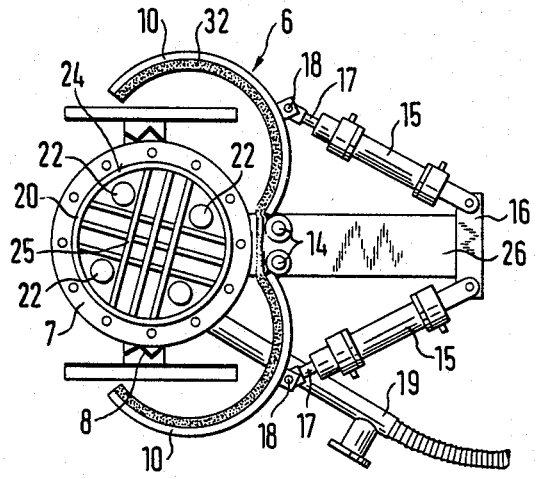
FIG. 5 is a view similar to FIG. 2 for a variation in embodiment.

FIG. 5 is a view similar to FIG. 2 for a somewhat varied embodiment.

No rubber cord is used in the embodiment of FIG. 5, rather a thicker foam or sponge rubber layer 32 or the like, the jaws 10 being so designed and so fitted to the housing 7 that they assume the uniform compression of this layer 32 when they are closed.

This embodiment operates as follows:

The individual containers 1 while being tied shut at their discharge stub 4 are moved over the emptying devices 6 fixed into the ground and are lowered until their discharge stub 4 spans the cylindrical housing 7 and enters the gap between the housing periphery and the rubber cord 11 or the layer 32. Then, by being loaded by the hydraulic or pneumatic units 15, the jaws 10 are made to rest against the discharge stub 4 above the housing 7, whereby the discharge stub 4 is clamped against the housing wall and whereby any pleats formed will be compressed. Thereupon the tied-together closure 5 (FIG. 1) is loosened and thereby the discharge of the in-bulk good may begin. Previously however the hollow cylinder 20 was moved upward into the discharge stub by being actuated by the hydraulic unit 29 until its upper edge 24 became flush with the container bottom 21 (FIG. 1). Compressed air is pulsated through the venting pipes 22 into the container 1 during the emptying procedure.

We claim:

1. In an apparatus for emptying a flexible or rigid container having a flexible discharge stub with a given inside diameter for holding in-bulk goods, said discharge stub being sealable by being tied shut and issuing into an emptying apparatus from where said in-bulk goods are conveyed out by partial vacuum or free fall, the improvement comprising:

said emptying apparatus (6) comprising an upright cylindrical housing (7) having an outside diameter less than said inside diameter of said discharge stub (4), said housing when connected to said discharge stub being spanned by said discharge stub, at least two jaws (10) pivotably mounted for opening and closing by actuating means around the entire periphery of said discharge stub around said housing and a space between said jaws and said housing when closed, at least one longitudinal stretchable elastic which in a closed state of said jaws rests while prestressed over said entire periphery of said discharge stub spanning said housing, said elastic located in said space and attaching to said jaws.

2. The apparatus of claim 1, wherein said longitudinal elastic is a rubber cord (11) having an approximately circular crosssection.

3. The apparatus of claim 1, wherein said longitudinal elastic (11) is held by flexible holders (12, 13) to said jaws (10).

4. The apparatus of claim 3, wherein one flexible holder (12) for said longitudinal elastic is provided for each jaw (10) and is mounted approximately in the middle of said jaw.

5. The apparatus of claim 4, wherein a further flexible holder (13) is mounted in the area between mutually adjacent supports (14) of the said jaws (10).

6. The apparatus of claim 4, wherein said jaws are pivotably supported with supports (14) located a distance away from said outside diameter of said housing, three holding sites provided for said longitudinal elastic, namely at a free end of each jaw, another a middle of each jaw and a third in an area of one of said supports.

7. The apparatus of claim 1, wherein a plurality of longitudinal elastics is provided mounted one over the other.

8. The apparatus of claim 1, wherein said jaws are pivotably supported, with supports (14) located a distance away from said outside diameter of said housing (7) which is larger than the initial diameter of said longitudinal elastic.

9. The apparatus of claim 8, wherein said jaws (10) are pivotable open and said longitudinal elastic is kept at a distance from said outside diameter of said housing.

10. The apparatus of claim 1, wherein each of said jaws (10) is semicircular.

11. The apparatus of claim 1, wherein said jaws (10) are linked to the means for actuation (15).

12. The apparatus of claim 11, wherein said jaws (10) are supported at the end of a piston rod (17) having a pneumatic actuation unit.

13. The apparatus of claim 11, wherein said jaws (10) are supported at the end of a piston rod (17) having a hydraulic actuation unit.

14. The apparatus of claim 12, wherein said pneumatic unit has a cylinder pivotably supported by a fixed crossbeam (16) of said housing (7).

15. The apparatus of claim 14, wherein said hydraulic unit has a cylinder pivotably supported by a fixed crossbeam (16) of said housing (7).

16. The apparatus of claim 1, wherein a hollow cylinder (20) is mounted within the housing (7) with means for telescoping upward.

17. The apparatus of claim 16, wherein said hollow cylinder (20) enters said discharge stub (4) of said container (1) until its upper edge (24) is flush with the container bottom (21).

18. The apparatus of claim 16, wherein said hollow cylinder (20) is equipped with venting means in the form of venting pipes (22) entering goods to be emptied.

19. The apparatus of claim 18, wherein two venting pipes (22) diametrically opposite to each other are provided in said hollow cylinder (20).

20. The apparatus of 18, wherein more than two venting pipes (22) are equidistantly distributed with respect to each other along the periphery over the end surfce of said hollow cylinder (20).

21. The apparatus of claim 20, wherein four venting pipes (22) are provided.

22. The apparatus of claim 18, wherein said venting pipes (22) are loaded in pulsating manner with means to provide compressed air.

23. The apparatus of 18, wherein said venting pipes (22) are equipped with clack valves (23) which when not loaded are actuated in closed position by means of compressed air.

24. The apparatus of claim 18, wherein said hollow cylinder (20) is provided near its upper end (24) with a grille (25).

25. In an apparatus for emptying a flexible or rigid container having a flexible discharge stub with a given inside diameter for holding in-bulk goods, said discharge stub being sealable by being tied shut and issuing into an emptying apparatus from where said in-bulk goods are conveyed out by partial vacuum or free fall, the improvement comprising:

said emptying apparatus (6) comprising an upright cylindrical housing (7) having an outside diameter less than said inside diameter of said discharge stub (4), said housing when connected to said discharge stub being spanned by said discharge stub, at least two jaws (10) pivotably mounted for opening and closing by actuating means around the entire periphery of said discharge stub around said housing and a space between said jaws and said housing when closed, stretchable elastic foam mounted to inside surfaces of said jaws which in a closed state of said jaws rests while prestressed over said entire periphery of said discharge stub spanning said housing, said foam located in said space.

* * * * *